US005913954A

United States Patent [19]

Arnold et al.

[11] Patent Number: 5,913,954

[45] Date of Patent: Jun. 22, 1999

[54] PAWL FOR A LOW PROFILE WRENCH

[75] Inventors: Robert L. Arnold, Jacobus, Pa.; Dana L. Delaney, South Windsor, Conn.; Derek Richner, Whately, Mass.; James A. Van Lenten, Lancaster, Pa.

[73] Assignee: Hand Tool Design Corporation, Wilmington, Del.

[21] Appl. No.: 08/928,117

[22] Filed: Sep. 12, 1997

[51] Int. Cl.[6] ..... B25B 13/46

[52] U.S. Cl. ..... 81/63.2; 81/60; 81/63; 81/63.1; 81/62

[58] Field of Search ..... 81/60, 63, 63.1, 81/63.2, 62, 58.4

[56] References Cited

U.S. PATENT DOCUMENTS

| | | | |
|---|---|---|---|
| Re. 23,661 | 5/1953 | Able et al. . | |
| 2,542,241 | 2/1951 | Fors . | |
| 3,250,157 | 5/1966 | Badger . | |
| 4,328,720 | 5/1982 | Shiel . | |
| 4,485,700 | 12/1984 | Colvin . | |
| 4,631,988 | 12/1986 | Colvin . | |
| 5,178,047 | 1/1993 | Arnold et al. . | |
| 5,626,062 | 5/1997 | Colvin | 81/63.2 |

*Primary Examiner*—David A. Scherbel
*Assistant Examiner*—Sinclair Skinner
*Attorney, Agent, or Firm*—Leonard Bloom

[57] ABSTRACT

A hand tool having a pawl with a flange formed on the bottom surface. A bore is formed axially in the pawl. A reversing lever is connected to the pawl. The pawl is received in an opening which has an annular shoulder, the flange on the pawl abutting the annular shoulder.

12 Claims, 7 Drawing Sheets

PAWL FOR A LOW PROFILE WRENCH

BACKGROUND OF THE INVENTION

The present invention relates to a pawl for a hand tool and, more particularly to a pawl having a flange on the bottom surface thereof and a bore therein in which a reversing lever is received.

A pawl is a mechanical device which allows rotation in one direction only and is a member usually found in a ratchet wrench, flex head wrench or other tool. In these tools the pawl is disposed in an opening in the head of the tool and has two spaced-apart sets of teeth formed on one face of the pawl to engage teeth in a gear or ratchet wheel. The pawl is pivotally moved to engage one or the other sets of teeth with the teeth on the gear to control forward or reverse movement of the gear. The pawls known to the applicant have sides which are continuous and uninterrupted. The only pawl which has a shoulder is disclosed in U.S. Pat. No. 2,542,241 to Fors which shows a partial shoulder on which a lever head is supported.

The pawl of the present invention provides a tool which has reduced manufacturing and assembly costs and provides for positive operations. It also is useful in a ratchet wrench with a low profile which enables a user to work in confined spaces where a wrench of the prior art cannot be used.

BRIEF SUMMARY OF THE INVENTION

It is an object of the present invention to provide a pawl for a hand tool which is usable with a socket gear in a low profile wrench.

It is a further object of the present invention to provide a pawl for a hand tool which can be manufactured economically and which has positive engagement with teeth on a gear.

In accordance with the teachings of the present invention, there is disclosed a ratchet wrench comprising a handle, a head having a top surface and a bottom surface, a pawl having two spaced-apart sets of teeth formed thereon and a reversing lever. The head has a first opening therethrough, and a geared tooth socket is received in the first opening. A blind second opening is formed in the bottom surface of the head proximal to the handle. The second opening communicates with the first opening. A shoulder is formed annularly around the second opening near the bottom surface of the head. A bore is formed in the top surface of the head, the bore communicating with the second opening in the head. The pawl has a body with a top surface and a bottom surface. The pawl body has a flange formed at the bottom surface. The pawl is disposed in the second opening wherein the flange on the pawl body abuts the shoulder in the second opening. The bottom surface of the pawl body is flush with the bottom surface of the head. A bore is formed axially in the pawl body. The bore in the pawl body communicates with the bore in the top surface of the head. A reversing lever is received in the bore in the pawl body. A selected one of the sets of teeth on the pawl body engages the geared tooth socket and movement of the reversing lever permits forward and reverse operation of the ratchet wrench.

In another aspect, there is disclosed a pawl for a hand tool, the pawl being received in an opening having an annular shoulder thereabout. The pawl includes a top surface and a bottom surface, a flange being formed at the bottom surface, a bore being formed axially in the pawl and two spaced-apart sets of teeth being formed on a front face of the pawl. A reversing lever is received in the bore in the pawl. The pawl is received in the opening wherein the flange on the pawl abuts the annular shoulder in the opening. Movement of the reversing lever orients one or the other of the sets of teeth outwardly for engagement with a gear.

These and other objects of the present invention will become apparent from a reading of the following specification taken in conjunction with the enclosed drawings.

DESCRIPTION

Figure 1:
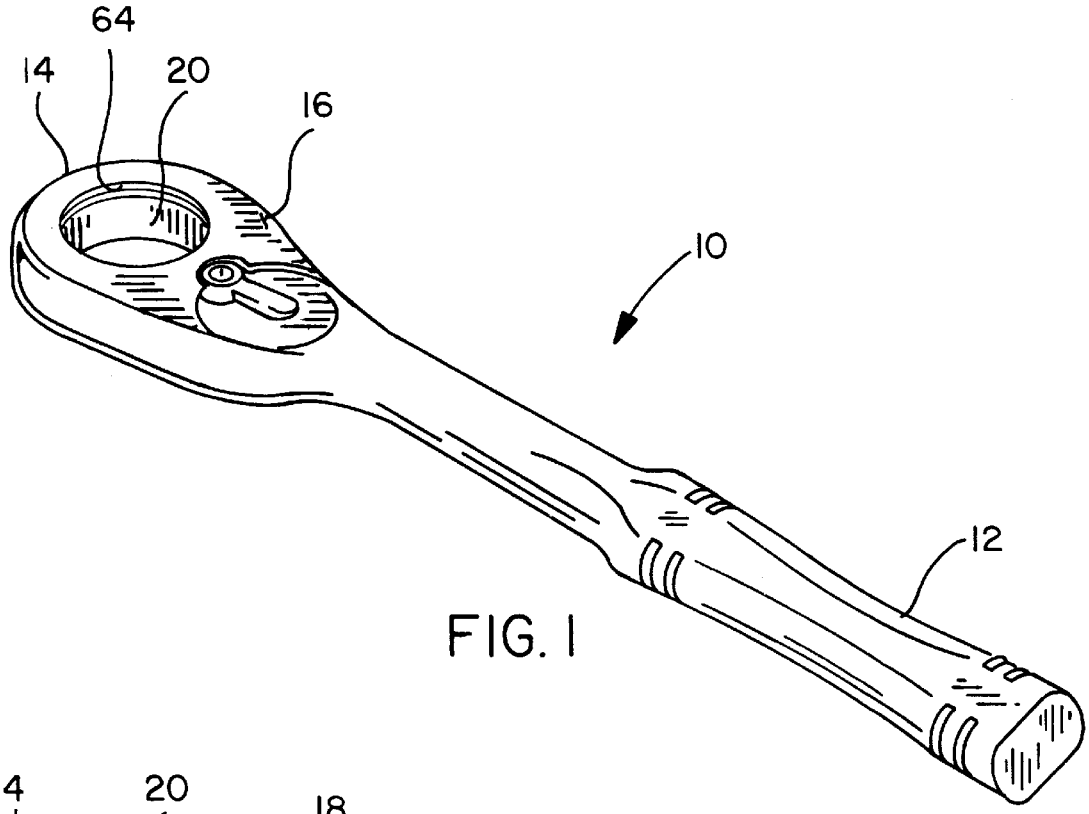
FIG. 1 is a perspective view of the ratchet wrench of the present invention showing the reversing lever and the first opening in the head in which the geared tooth socket is received.
Figure 2:
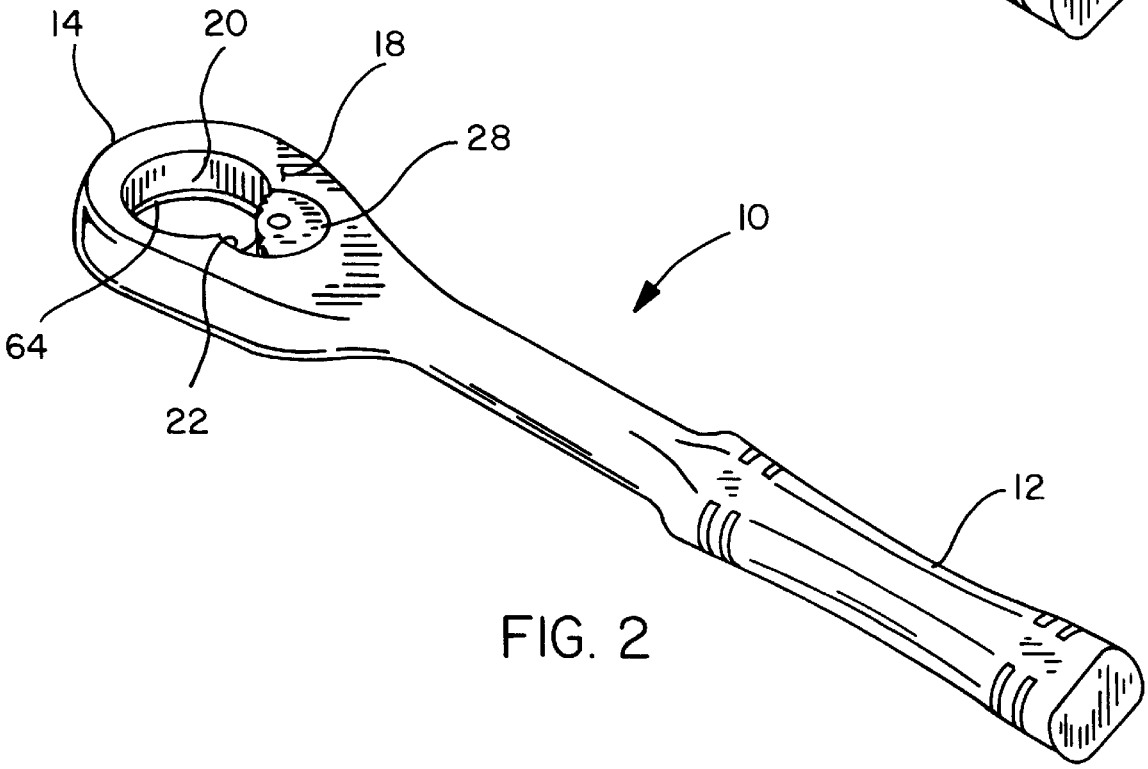
FIG. 2 is a bottom view of the ratchet wrench showing the pawl in the second opening and first opening in which the geared tooth socket is received.
Figure 3:
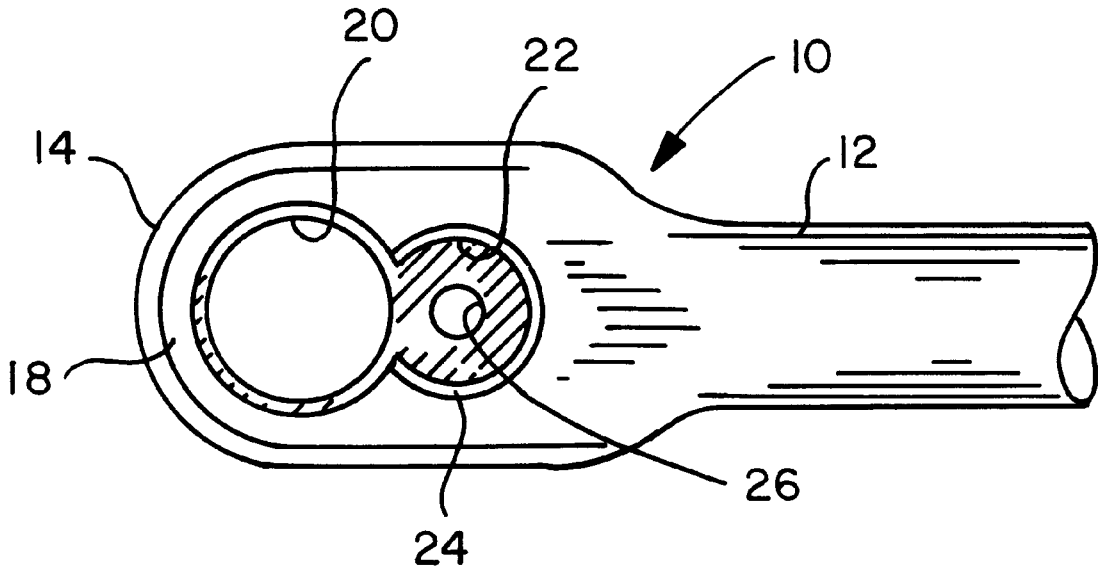
FIG. 3 is a bottom plan view of the body of the ratchet wrench showing the first opening and the second opening in the head without a pawl and without a geared tooth socket.
Figure 4:
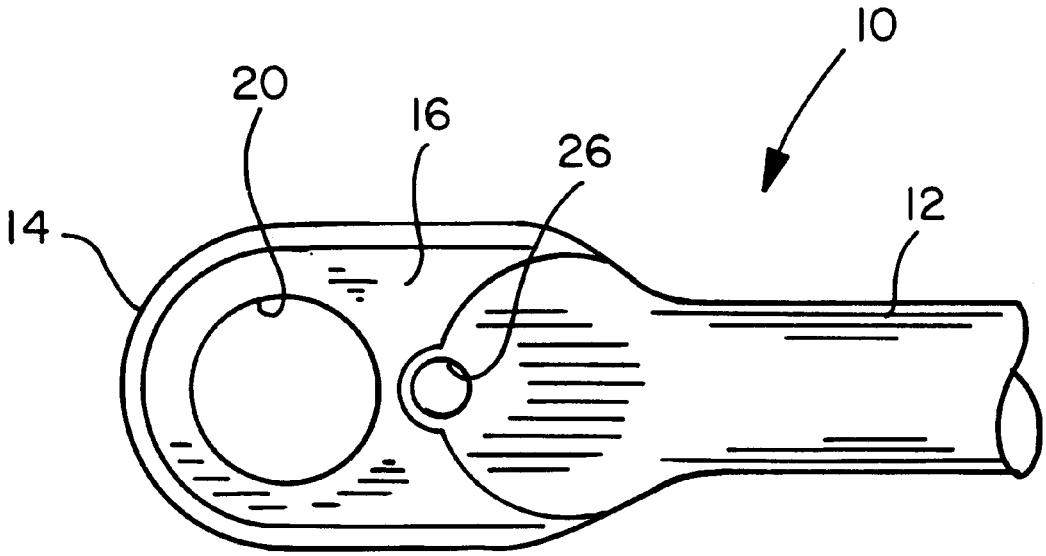
FIG. 4 is a top plan view of the body of the ratchet wrench showing the first opening and the second opening in the head.
Figure 5:
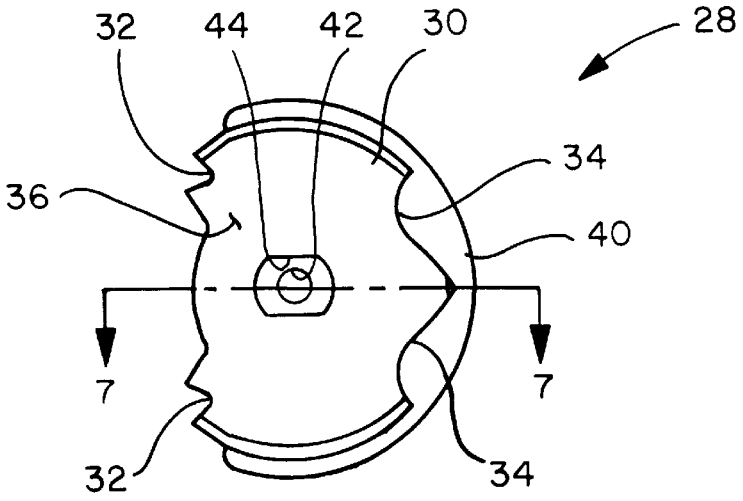
FIG. 5 is a top plan view of the pawl of the present invention.
Figure 6:
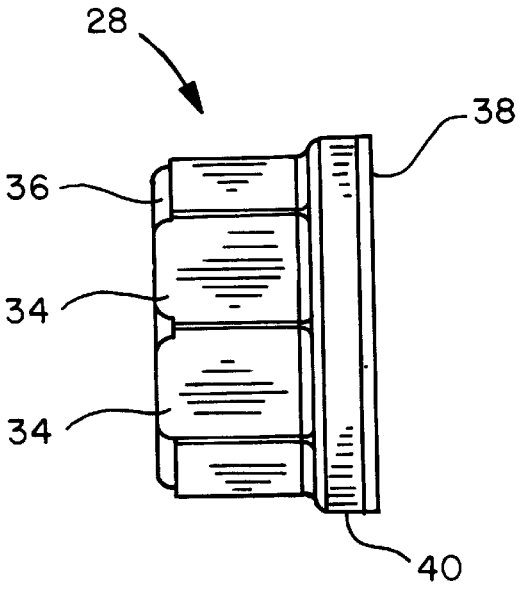
FIG. 6 is a back elevation view of the present invention.
Figure 7:
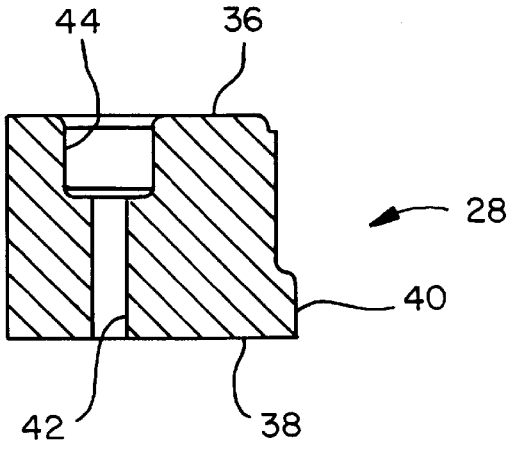
FIG. 7 is a cross-sectional view taken across the lines 7—7 of FIG. 5.
Figure 8:
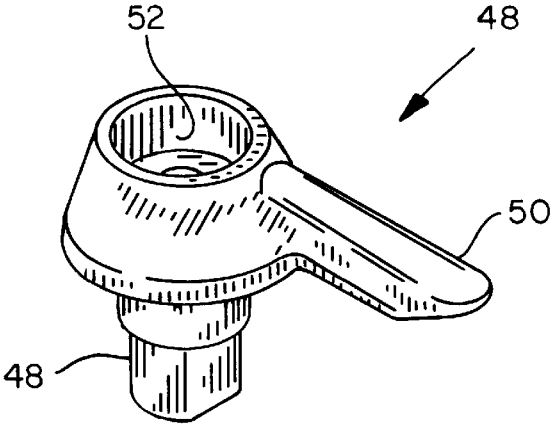
FIG. 8 is a perspective view from the top of the pawl.
Figure 9:
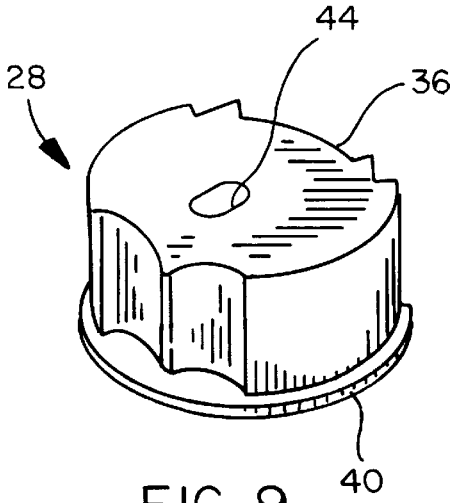
FIG. 9 is a perspective view of the reversing lever of the present invention.
Figure 10:
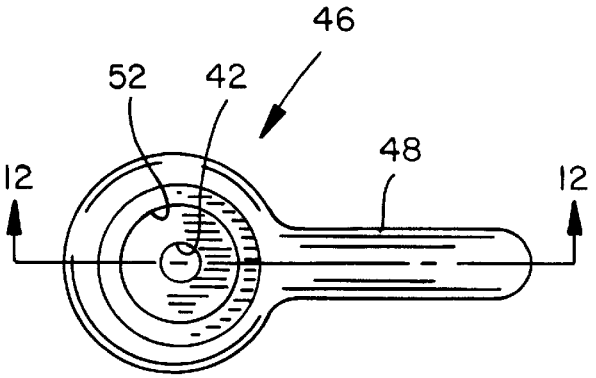
FIG. 10 is a top plan view of the reversing lever.
Figure 11:
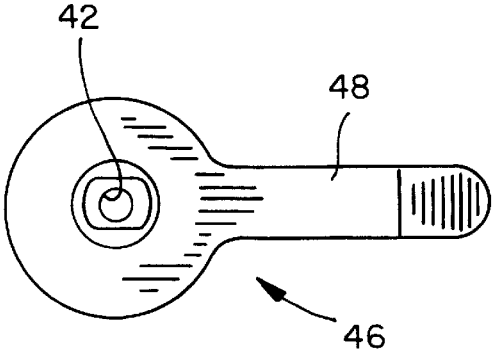
FIG. 11 is a bottom plan view of the reversing lever.
Figure 12:
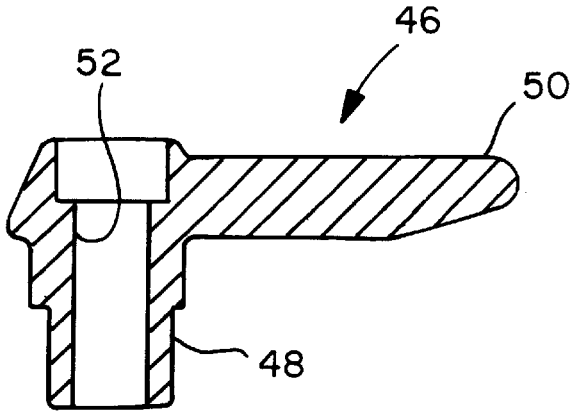
FIG. 12 is a cross-sectional view taken across the lines 12—12 of FIG. 10.

Referring now to FIGS. 1–4, the present invention is for a pawl which is used in a hand tool. The preferred tool is a ratchet wrench 10 which has a handle 12 and a head 14. The head has a top surface 16 and a bottom surface 18 with a first opening 20 between the surfaces 16, 18. A blind second opening 22 is formed in the bottom surface 18 of the head 14. The second opening 22 is proximal to the handle 12 and communicates with the first opening 20. A shoulder 24 is formed annularly in the second opening 22 near the bottom surface 18 of the head 14. The second opening 22 terminates near the top surface 16 of the head 14, there being a portion of the top surface 16 capping the second opening 22. A bore 26 is formed in the cap portion of the top surface 16. The bore 26 communicates with the second opening 22 in the head 14.

As shown in FIGS. 5–8, a pawl 28 has a body 30 which has two spaced-apart sets of teeth 32 formed on a front face and a pair of adjacent pockets 34 formed on the opposite rear face. The pawl body 30 has a top surface 36 and a bottom surface 38. It is preferred that both sets of teeth extend from the top surface 36 to the bottom surface 38. A flange 40 is formed at the bottom surface 28. Preferably, the flange 40 extends around the sides of the pawl body 30 and the rear face but does not extend around the front face nor over the sets of teeth 32 on the pawl body 30. Preferably, the bore 42 is threaded axially in the pawl body 30. A counterbore 44 is formed near the top surface 30 of the pawl body 30 and around the bore 42. The counterbore 42 is non-circular, having a polygonal, double D, oval or other shape to permit keying of the pawl body 30 as will be described.

The pawl 28 is received in the second opening 22 in the head 14 of the wrench with the flange 40 on the pawl body 30 abutting the shoulder 24 in the second opening 22. When so disposed, the bottom surface 38 of the pawl body 30 is substantially flush with the bottom surface 18 of the head 14 and the bore 42 in the pawl body 30 communicates with and is axially aligned with, the bore 20 in the top surface 16 of the head 14.

A reversing lever 46 has a shaft 48 which is substantially perpendicular to a lever arm 50 as shown in FIGS. 9–12. The reversing lever 46 is disposed on the top surface 16 of the head 14 with the shaft 48 extending through the bore 26 in the top surface 16 of the head 14 and into the counterbore 44 in the pawl body 30. The lever arm 50 extends toward the handle 12 and is substantially parallel to the top surface 16 of the head 14. The shaft 48 preferably is configured to key to the counterbore 42 in the pawl body 30 such that pivoting of the reversing lever 46 produces similar pivotal movement in the pawl 28. It is further preferred that the shaft 48 have an opening 52 formed therein. Connecting means 54 are provided to connect the shaft 48 with the pawl body 30. The connecting means 54 may include, but is not limited to, a threaded screw, expandable legs, detents, retaining rings, rivets and other means known to persons skilled in the art.

The ratchet wrench 10 has a detent means 56 to urge the pawl 28 into engagement with the ratchet gear 58 and to permit the reversing lever 46 to pivot the pawl 28 between the forward and reverse positions. The detent means 56 includes a bore formed in the handle (not shown) and a spring and ball disposed in the bore to be received in a selected pocket 34 in the rear face of the pawl 28.

The present invention is most advantageously used with a combined socket/gear 60 (a geared tooth socket) which is a socket having a plurality of gear teeth arranged axially around the outer circumference of a portion of the socket. The socket/gear 60 has an axial through opening. The inner surface of the through opening in the socket/gear 60 has means thereon to engage a fastener. It is preferred that a shoulder 64 be formed near the top surface 16 in the first opening 20 in the head 14 of the ratchet wrench 10. The shoulder 64 may have a groove formed therein to receive a retaining ring to engage a cooperating groove in the upper portion of the socket/gear 60 as is disclosed in pending U.S. Pat. application Ser. No. 08/904,177. Means are provided to removably receive the socket/gear 60 in the first opening 20 in the head 14. The means may be a spring or retaining ring and groove relationship between the head of the wrench and socket/gear or other retaining means known to persons skilled in the art. In this manner, a plurality of socket/gears may be used with the wrench 10, the inner surface of each socket/gear 60 having means to engage a fastener of a different size from the other socket/gears. The ratchet wrench with these socket/gears and the pawl of the present invention has a profile lower than most ratchet wrenches presently available. This has the advantage of permitting use of the ratchet wrench in confined spaces where ratchet wrenches with higher profiles cannot be used.

Figure 13:
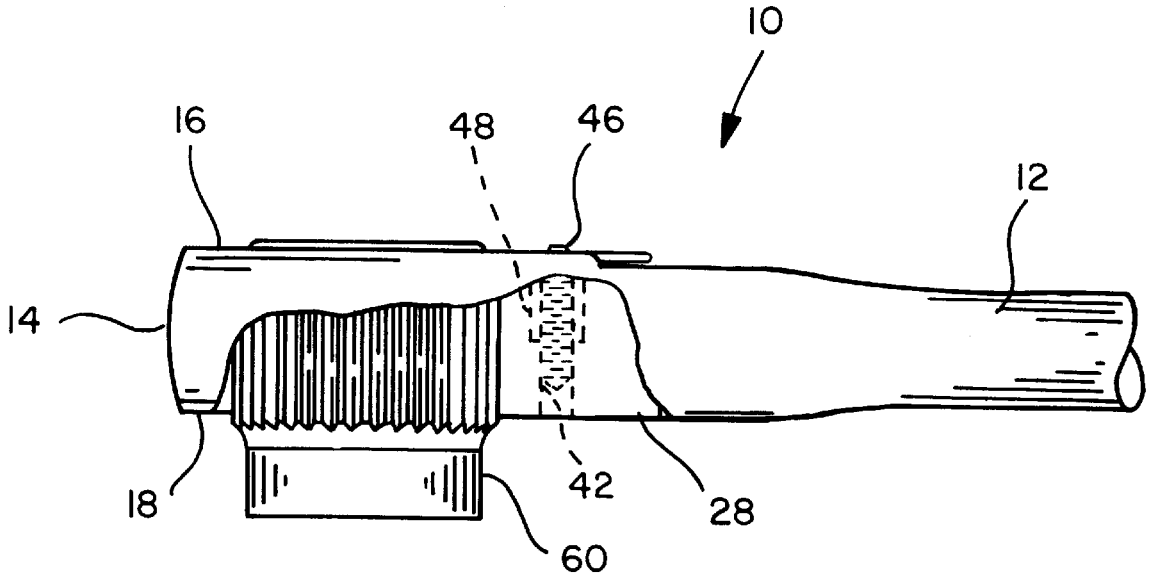
FIG. 13 is a cross-sectional view of the ratchet wrench showing the pawl, reversing lever and socket gear.
Figure 14:
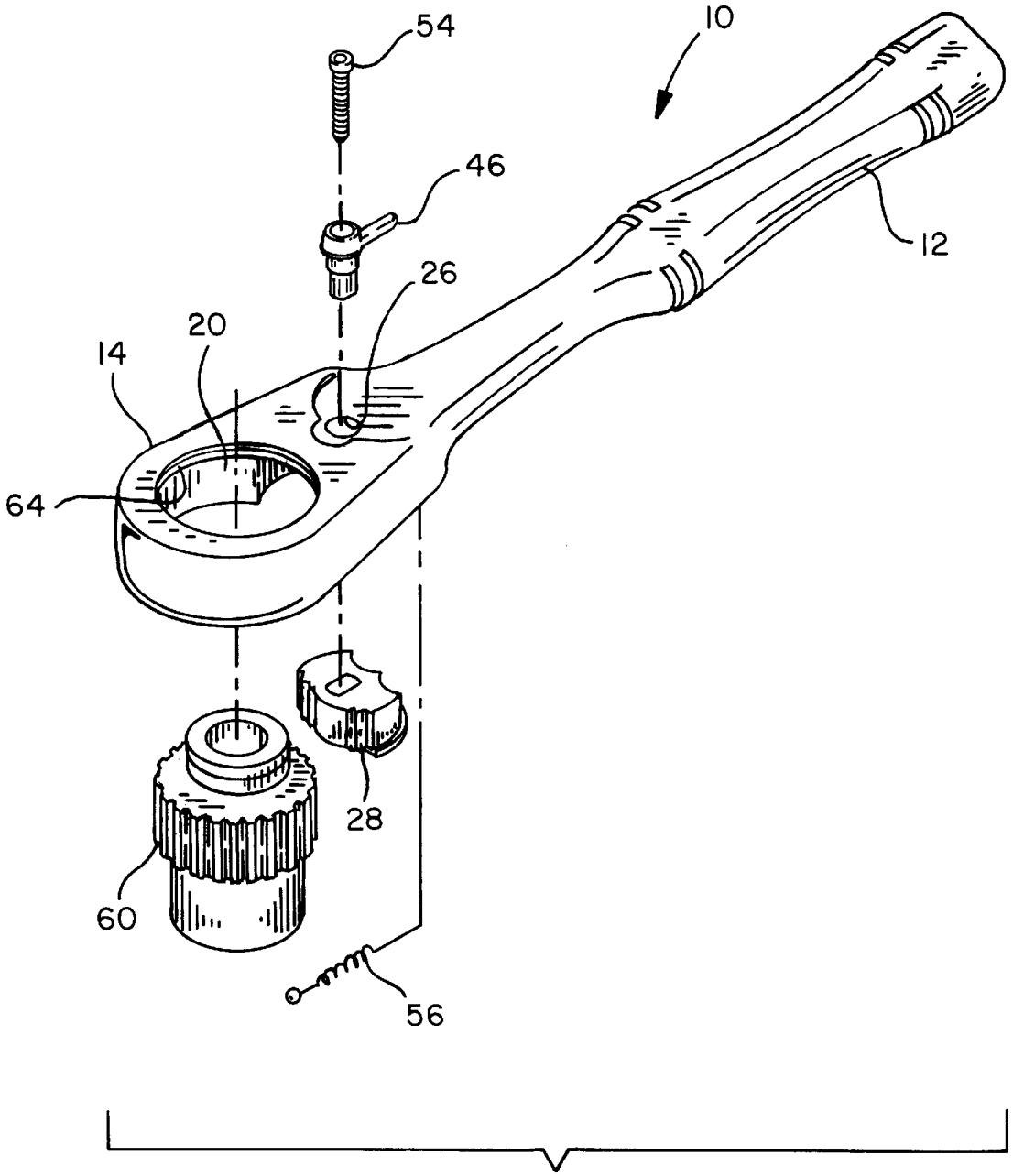
FIG. 14 is an exploded view showing the ratchet wrench, the socket gear, the pawl, the reversing lever, the screw for the reversing lever and the detent means.

The assembly of the ratchet wrench 10 is shown in FIGS. 13 and 14. The pawl 28 is disposed in the second opening 22 in the head 14 from the bottom surface 18 of the head with the shoulder 24 supporting the flange 40 on the pawl 28. The shaft 48 of the reversing lever 46 is received in the bore 26 in the top surface 16 of the head 14 and is keyed to the counterbore 44 in the pawl body 30. Connecting means 54 disposed in the opening 52 in the shaft secures the reversing lever 46 to the pawl 28 and to the wrench 10. A selected socket/gear 60 is inserted in the first opening 20 in the head 14. One of the sets of teeth 32 on the pawl 28 engage the teeth on the socket/gear 60. The entire length of the teeth on the pawl 28 from the top surface 36 to the bottom surface 38 of the pawl body 30 engage the teeth on the socket/gear 60 to provide maximum surface area of contact and maximum transmission of torque and to reduce stress on both sets of teeth. Rotation of the reversing lever 46 produces a corresponding rotation of the pawl 28 due to the keying of the shaft 48 on the reversing lever 46 with the counterbore 44 in the pawl 28. The detent means 56 engages one of the pockets 34 in the rear face of the pawl body 30 and urges one of the sets of teeth 32 on the pawl body 30 into engagement with the teeth on the ratchet gear (or the socket gear).

Preferably, there is no cover plate on the bottom surface 18 of the head 14 as is found on many ratchet wrenches of the prior art. This permits easy removal and insertion of the socket/gear 60 into the first opening 20 in the head 14 and provides for a thinner ratchet head and a lower profile with improved strength. The bottom surface 38 of the pawl body 30 is in the same plane as the bottom surface 18 of the head 14. This configuration permits inspection of the teeth on the pawl 28 without disassembling the ratchet wrench.

Figure 15:
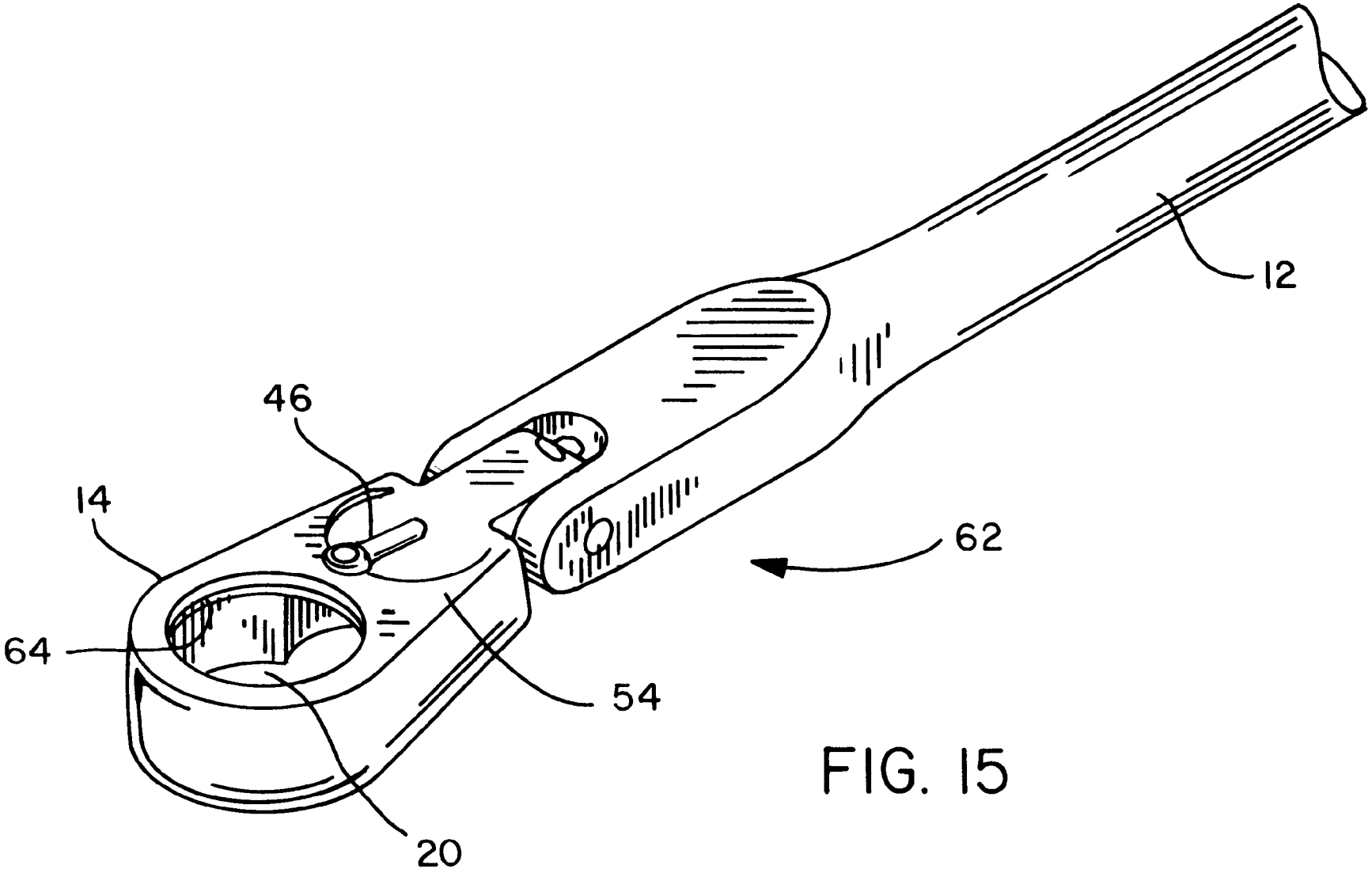
FIG. 15 is a perspective view of a flex head wrench having a pawl of the present invention.

The pawl of the present invention is useful with hand tools in addition to the ratchet wrench. For example, FIG. 15 shows the pawl of the present invention in a flex head wrench 62. The pawl of the present invention may be used in any tool which requires a pawl.

The pawl of the present invention is comparatively inexpensive to produce and assemble in a tool. Repair and maintenance costs are low. Operation of the tool is very efficient due to the maximum contact between the pawl teeth and the ratchet gear teeth. The pawl is readily useful in a low profile wrench.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A ratchet wrench comprising a handle, a head having a top surface and a bottom surface, a pawl having two spaced-apart sets of teeth formed thereon and a reversing lever, the head having a first opening therethrough, a geared tooth socket being received in the first opening, a blind second opening formed in the bottom surface of the head proximal to the handle, the second opening communicating with the first opening, a shoulder formed annularly around the second opening near the bottom surface of the head, a bore formed in the top surface of the head, the bore communicating with the second opening in the head, the pawl having a body with a top surface and a bottom surface, the pawl body having a flange formed at the bottom surface, the pawl being disposed in the second opening wherein the flange on the pawl body abuts the shoulder in the second opening, the bottom surface of the pawl body being flush with the bottom surface of the head, a bore being formed axially in the pawl body, the bore in the pawl body communicating with the bore in the top surface of the head, a reversing lever received in the bore in the pawl body, and wherein a selected one of the sets of teeth on the pawl body engages the geared tooth socket and movement of the reversing lever permits forward and reverse operation of the ratchet wrench.

2. The ratchet wrench of claim 1, wherein the geared tooth socket is a socket having a plurality of gear teeth formed circumferentially on an outer surface thereof, the socket having an axial through opening having an inner surface, the inner surface having means thereon to engage a fastener.

3. The ratchet wrench of claim 2, wherein the geared tooth socket is removably received in the first opening, permitting the use of a plurality of geared tooth sockets with the ratchet wrench, each geared tooth socket having a means to engage a fastener of a different size from the other geared tooth sockets.

4. The ratchet wrench of claim 1, wherein the sets of teeth on the pawl extend from the top surface of the pawl to the bottom surface of the pawl wherein maximum surface area is provided for contact between teeth on the pawl and the geared tooth socket.

5. The ratchet wrench of claim 1, wherein the reversing lever has a shaft formed substantially perpendicular to a lever arm, the shaft being keyed to the bore in the pawl wherein rotation of the lever arm produces comparable rotation of the pawl.

6. The ratchet wrench of claim 5, wherein the shaft of the reversing lever has an opening formed therein, a connecting means being disposed in the opening in the shaft and extending into the bore in the pawl to retain the reversing lever on the pawl with the lever arm on the reversing lever being approximately parallel to the top surface of the head.

7. A pawl for a hand tool, the pawl being received in an opening having an annular shoulder thereabout, the pawl comprising:

a top surface and a bottom surface, a flange being formed at the bottom surface, a bore being formed axially in the pawl, two spaced-apart sets of teeth being formed on a front face of the pawl, a reversing lever received in the bore in the pawl, the pawl being received in the opening wherein the flange on the pawl abuts the annular shoulder in the opening, wherein movement of the reversing lever orients one or the other of the sets of teeth on the pawl outwardly for engagement with a gear.

8. The pawl of claim 7, wherein the sets of teeth extend from the top surface of the pawl to the bottom surface of the pawl.

9. The pawl of claim 7, wherein the reversing lever has a shaft formed thereon, the shaft in the reversing lever and the bore in the pawl each having cooperating keying means formed thereon wherein the reversing lever is keyed to the pawl and movement of the reversing lever between alternate positions produces like movement of the pawl.

10. The pawl of claim 9, wherein the shaft on the reversing lever is connected to the pawl by a connecting means.

11. A low-profile ratchet wrench, comprising a handle including a head having top and bottom surfaces and further having a first opening formed therein between the top and bottom surfaces thereof; the head further having a second blind opening formed therein anteriorly of the first opening, extending from the bottom surface of the head, and forming a shoulder in the head of the wrench; a pawl received in the second blind opening through the bottom surface of the head and abutting the shoulder; a reversing lever on the head, accessible from the top surface thereof, and having a stem fixedly received in the pawl for conjoint movement; and a gear socket, selected from a plurality of gear sockets, received in the first opening in the head, releasably retained therein, the gear socket having a plurality of gear teeth arranged axially about an outer circumference of the gear socket, the pawl having two spaced-apart sets of teeth formed thereon; a selected one of the sets of teeth on the pawl directly engaging the gear teeth on the gear socket.

12. The low-profile ratchet wrench of claim 11, wherein the first opening comprises a first through opening in the head of the wrench.

* * * * *